United States Patent [19]

Doyle

[11] 4,222,328

[45] Sep. 16, 1980

[54] DOCTOR BLADE LIQUID APPLICATOR FOR METERING ROLLS

[75] Inventor: Walter V. Doyle, Trinity, N.C.

[73] Assignee: Flex-O-Line Division of Kenton Machine Works, Portland, Oreg.

[21] Appl. No.: 926,725

[22] Filed: Jul. 21, 1978

[51] Int. Cl.[2] ..... B41L 27/06; B41L 27/08; B41F 31/04; B41F 31/06

[52] U.S. Cl. ..... 101/350; 101/366; 101/169; 118/261

[58] Field of Search ..... 101/366, 363, 350, 364, 101/365, 207, 208, 210, 148, 157, 169; 118/259, 261, 404, 405, 410

[56] References Cited

U.S. PATENT DOCUMENTS

| | | | |
|---|---|---|---|
| 2,787,244 | 4/1957 | Hickin | 118/259 |
| 2,823,607 | 2/1958 | Butcher et al. | 101/363 |
| 2,931,297 | 4/1960 | Coudriet | 101/157 |
| 3,104,182 | 9/1963 | Schneider | 118/261 |
| 3,120,802 | 2/1964 | Smejda | 101/364 |
| 3,186,335 | 6/1965 | Gaulin | 101/157 |
| 3,192,895 | 7/1965 | Galer | 118/410 X |
| 3,379,171 | 4/1968 | Cordingly et al. | 118/261 |
| 3,585,932 | 6/1968 | Granger | 101/208 |
| 3,703,459 | 11/1972 | Little, Jr. et al. | 118/259 X |
| 3,788,220 | 1/1974 | Laben et al. | 101/363 |
| 3,815,499 | 6/1974 | Abler | 101/364 |

FOREIGN PATENT DOCUMENTS

| | | | |
|---|---|---|---|
| 1002698 | 8/1965 | United Kingdom | 118/259 |

*Primary Examiner*—J. Reed Fisher
*Attorney, Agent, or Firm*—Oliver D. Olson

[57] ABSTRACT

The framework supporting the ink metering roll for the print cylinder of a printing press also supports an ink applicator doctor blade which terminates inwardly of the opposite ends of the metering roll, the end portions of the doctor blade extending angularly upward from the intermediate portion to form with the metering roll an ink reservoir to one end of which ink is supplied from a main source of supply and from the opposite end of which excess ink is returned to the source. Resilient pressure is applied to the doctor blade to maintain it in sealing engagement with the metering roll.

16 Claims, 2 Drawing Figures

DOCTOR BLADE LIQUID APPLICATOR FOR METERING ROLLS

BACKGROUND OF THE INVENTION

This invention relates to the application of inks, dyes, glues and other liquids to sheet or web material, and more particularly to a novel doctor blade associated with the roll which meters such liquids to an applicator.

Doctor blades heretofore employed with printing press ink and other liquid metering rolls extend the full length of the metering roll and therefore require ink collector mechanism for recovering excess liquid which discharges from the opposite ends of the metering roll. Such mechanism requires significant space at the ends of the metering roll for its installation and adds materially to the cost of the equipment. It also is not completely satisfactory, since ink or other liquid still accumulates at the ends of the metering roll as it runs off, and is transferred to the print cylinder or other applicator as undesirable excess.

SUMMARY OF THE INVENTION

In its basic concept, this invention provides a doctor blade for the metering roll of a liquid applicator, which doctor blade terminates inwardly of the ends of the metering roll and forms with the latter a closed end reservoir from which liquid is supplied to the metering roll.

It is by virtue of the foregoing basic concept that the principal objective of this invention is achieved; namely, to overcome the aforementioned limitations and disadvantages of prior doctor blade liquid applicators.

Another objective of this invention is the provision of a doctor blade liquid applicator of the class described which is of simplified construction for economical manufacture.

A specific objective of this invention is the provision of a doctor blade ink applicator of the class described which is capable of integration into substantially all conventional forms of printing presses.

The foregoing and other objects and advantages of this invention will appear from the following detailed description, taken in connection with the accompanying drawing of a preferred embodiment.

DESCRIPTION OF PREFERRED EMBODIMENT

Figure 1:
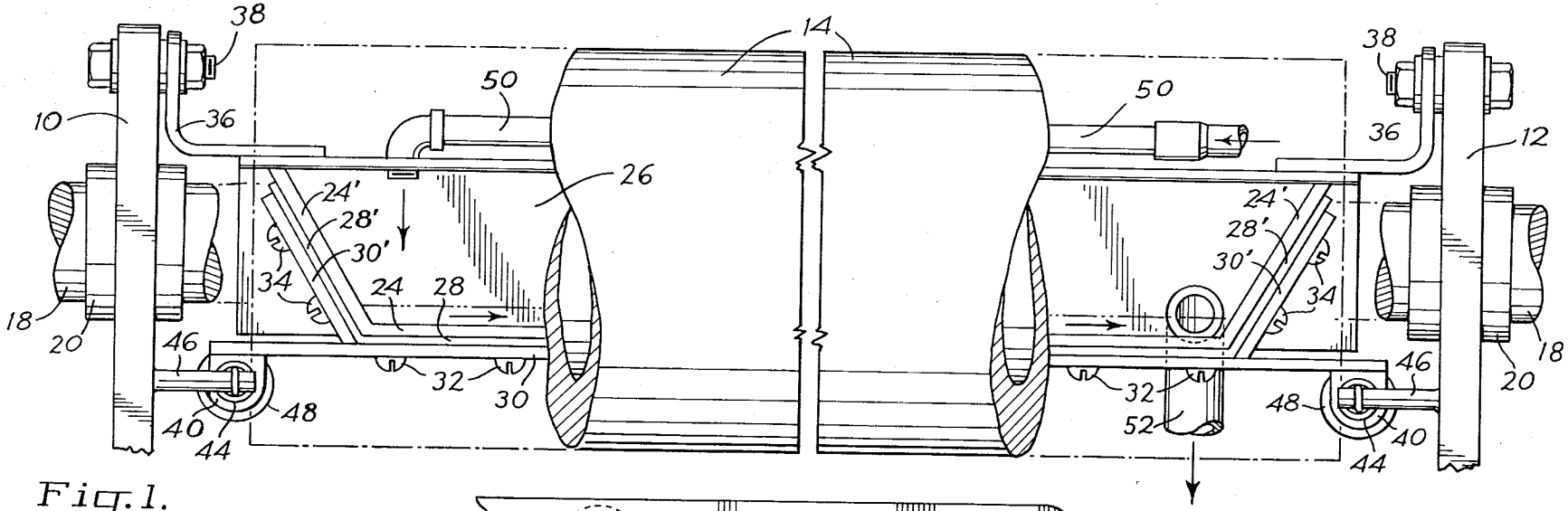
FIG. 1 is a fragmentary, foreshortened transverse vertical elevation of a print cylinder type printing press having associated with the ink metering roll thereof a doctor blade ink applicator embodying the features of this invention, parts being broken away to disclose internal structural details.

For purposes merely of illustration, the drawing shows portions of one form of conventional printing press of the print cylinder type. It includes a pair of laterally spaced frame members 10 and 12 which support between them an ink metering roll 14 for applying ink to the print cylinder 16 of a printing press. The frame members 10 and 12 are considered to be component parts of the frame of the printing press and may be permanent or detachable parts thereof. As illustrated, the ink metering roll is mounted for rotation with a driven shaft 18 which extends through bearings 20 on the frame members.

In accordance with this invention, a doctor blade ink applicator is provided for supplying ink in predetermined quantity to the ink metering roll in such manner as to avoid the complications incident to the use of previously described conventional doctor blades which extend to the opposite ends of the metering roll. Thus, the doctor blade ink applicator of this invention terminates inwardly of the opposite ends of the metering roll, with the end portions extending angularly upward from the intermediate portion to form with the metering roll an ink reservoir from which ink is supplied to the roll.

In the embodiment illustrated, the doctor blade is formed of an elongated channel-shaped member, preferably of metal, providing a top wall 22 and a bottom clamp wall 24, joined by an intermediate back wall 26. Opposite end portions 24' of the bottom clamp wall are offset angularly upward from the intermediate portion and joined to the latter to form a liquid tight seal. Although the offset may be 90° with respect to the intermediate portion, it is preferred that the end portions extend upward and outward from the intermediate portion at an oblique angle, as illustrated in FIG. 1.

The bottom clamp wall forms a support for an elongated flexible doctor blade. As illustrated, it is in the form of an elongated strip 28 of flexible material such as rubber or any of a wide variety of synthetic thermoplastic resins, such as nylon.

The doctor blade strip is placed against the outer side of the intermediate portion of the bottom clamp wall 24 and secured thereto removably by clamp bar 30. A plurality of screws 32 extend through openings in the clamp bar and doctor blade and are secured in registering tapped openings in the bottom clamp wall of the channel member. Short end clamp bars 30' bear against the outer end portions 28' of the doctor blade which are bent upwardly to bear against the angularly offset end portions 24' of the channel member, being secured thereto by means of screws 34.

Figure 2:
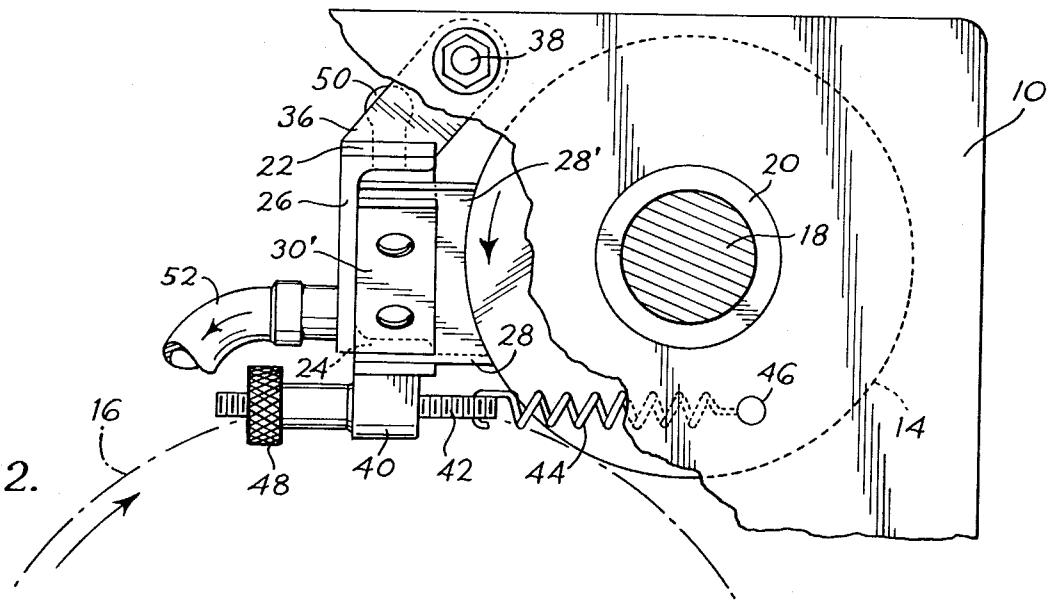
FIG. 2 is a fragmentary end elevation as viewed from the left in FIG. 1, parts being broken away to disclose internal structural details.

Referring to FIG. 2, it is to be noted that the doctor blade strip 28 projects forwardly beyond the front edge of the channel member for engagement with the surface of the ink metering roll, as discussed hereinafter.

The assembly of the channel member, doctor blade and clamp bars forms a doctor blade member for cooperative association with the ink metering roll 14. To this end, the doctor blade member is supported on the press frame in position to extend parallel to the metering roll and with the front edge of the flexible doctor blade 28, 28' in sliding, sealing engagement with the surface of the metering roll. In this manner the doctor blade member forms with the metering roll a closed end reservoir for printing ink.

In the embodiment illustrated, the doctor blade member is mounted on the press frame for pivotal movement toward and away from the metering roll 14. For this purpose, end brackets 36 are secured to the opposite end portions of the upper wall 22 of the channel member and are provided with upwardly offset outer end portions which are perforated to receive the pivot bolts 38 mounted in the press frame members. As best shown in FIG. 2, this pivotal mounting allows the doctor blade member to swing toward and away from the metering roll.

The bottom side of the doctor blade member is supported relative to the press frame to position the front edge of the flexible doctor blade 28, 28' in predetermined pressure contact with the surface of the metering roll. In the preferred embodiment illustrated, a boss 40 projects downward from the laterally projecting portions of the clamp bar 30, and each of the bosses is provided with a bore through which to freely receive an elongated threaded rod 42. The front end of the rod is provided with a diametric bore for reception of one end of a tension coil spring 44, the opposite end of which is secured to an anchor pin 46 extending laterally inward from the adjacent frame member of the press.

An adjustment nut 48 is provided with a threaded bore for reception of the rearward threaded portion of the rod 42 projecting rearwardly from the boss 40. Accordingly, rotation of the adjustment nut causes the threaded rod to be moved axially to vary the tension of the spring 44 and thus vary the resilient force with which the doctor blade is pressed against the metering roll.

It will be understood that the tension spring 44 may be replaced with other forms of devices, such as air cylinders, providing a resilient force by which the doctor blade is pressed against the metering roll. Further, resilient force may be replaced with positive force. For example, the tension spring may be omitted and the elongated threaded rod 42 extended into positive attachment to the anchor pin 46 projecting from the press frame member.

Although printing ink may be supplied manually to the reservoir formed by the doctor blade member and metering roll, it is preferred that ink be circulated continuously from a main source to the reservoir and thence back to the main source. To this end, an infeed circuit 50 is arranged with its outlet end secured to and extending through the top wall 22 of the channel member adjacent one end of the latter. The opposite end of the infeed conduit is coupled to the outfeed of a circulating pump (not shown) the inlet of which communicates with a main storage supply of printing ink (also not shown). A return conduit 52 also is provided with its inlet end extending through the back wall 26 of the channel member adjacent the bottom clamp wall 24 thereof at the end of the doctor blade member opposite the outlet end of the inlet conduit 50. The opposite end of the return conduit communicates with the main ink storage supply. Thus, printing ink is circulated continuously through the reservoir of the doctor blade member, in the direction indicated by the arrows in FIG. 1. This arrangement provides a continuously fresh supply of ink of substantially constant volume within the reservoir, and thus insures uniform application and quality of ink to the metering roll.

It is to be noted, particularly from FIG. 1 of the drawing, that the supply of ink is confined within the reservoir and therefore inwardly of the opposite ends of the metering roll. This arrangement avoids the prior requirement of providing ink collecting mechanism adjacent the opposite ends of the metering roll for collecting excess ink flowing laterally outward at the opposite ends of the metering roll. It also prevents the accumulation of such ink at the lateral ends of the metering roll which is transferred to the print cylinder as undesirable excess ink.

It will be understood from the foregoing that the doctor blade applicator of this invention may be utilized to apply to a metering roll a predetermined amount of many types of liquids other than printing inks and dyes. For example, it may be used to apply glues, adhesives, or other coatings in the manufacture of plywood, laminated paper and other sheet products.

It will be apparent to those skilled in the art that various changes may be made in the size, shape, type, number and arrangement of parts described hereinbefore without departing from the spirit of this invention.

Having now described my invention and the manner in which it may be used, I claim:

1. For use with a liquid metering roll mounted on the frame of liquid applying apparatus, a doctor blade liquid applicator comprising:

(a) an elongated, flexible doctor blade member having an intermediate portion arranged for engaging the surface of a metering roll along an intermediate portion of the length of the roll, (b) the doctor blade member having opposite end portions extending angularly upward from the intermediate portion and arranged for engaging circumferential end portions of the metering roll, and (c) mounting means connected to the doctor blade member arranged for engaging the frame of liquid applying apparatus for supporting the doctor blade member in liquid sealing engagement with the metering roll, the doctor blade member forming with the mounting means and metering roll a closed end liquid reservoir for supplying liquid to the metering roll, the intermediate portion of the doctor blade member forming the bottom of the reservoir, the end portions of the doctor blade member forming the closed ends of the reservoir, the mounting means forming the back of the reservoir and the metering roll forming the front of the reservoir.

2. The doctor blade liquid applicator of claim 1 including liquid inlet means for supplying liquid to the formed reservoir from a source of liquid, and liquid outlet means for returning excess liquid to the source of liquid.

3. The doctor blade liquid applicator of claim 1 including liquid inlet means adjacent one end of the reservoir for supplying liquid to the reservoir from a source of liquid, and liquid outlet means adjacent the other end of the reservoir for returning excess liquid to the source of liquid.

4. The doctor blade liquid applicator of claim 1 wherein the doctor blade mounting means includes inner and outer clamp members and the doctor blade member comprises an elongated flexible blade member secured between the inner and outer clamp members and extending forwardly beyond the latter for engagement of its projecting edge against the surface of a liquid metering roll.

5. The doctor blade liquid applicator of claim 4 wherein the flexible blade is of synthetic thermoplastic resin.

6. The doctor blade liquid applicator of claim 1 wherein the opposite end portions of the doctor blade member diverge upward from the intermediate portion.

7. The doctor blade liquid applicator of claim 1 wherein the mounting means includes resilient means for urging the doctor blade member resiliently toward the metering roll.

8. The doctor blade liquid applicator of claim 7 including adjustment means associated with the resilient means for varying the degree of resilient force urging the doctor blade member toward the metering roll.

9. The doctor blade liquid applicator of claim 1 wherein the mounting means includes pivot means for moving the doctor blade member arcuately toward and away from the metering roll, and resilient means arranged to interengage the mounting means and apparatus frame for urging the doctor blade member resiliently toward the metering roll.

10. The doctor blade liquid applicator of claim 9 including adjustment means associated with the resilient means for varying the degree of resilient force urging the doctor blade member toward the metering roll.

11. The doctor blade liquid applicator of claim 1 wherein the liquid metering roll is an ink metering roll and the liquid applying apparatus is a printing press.

12. In combination with a liquid metering roll mounted on the frame of liquid applying apparatus, a doctor blade liquid applicator, comprising:

(a) an elongated flexible doctor blade member having an intermediate portion engaging the surface of the metering roll along an intermediate portion of the length of the roll, (b) the doctor blade having opposite end portions diverging angularly upward from the intermediate portion and engaging circumferential end portions of the metering roll, (c) mounting means interengaging the doctor blade member and apparatus frame for supporting the doctor blade member in liquid sealing engagement with the metering roll, the doctor blade member forming with the mounting means and metering roll a closed end liquid reservoir for supplying liquid to the metering roll, the intermediate portion of the doctor blade member forming the bottom of the reservoir, the end portions of the doctor blade member forming the closed ends of the reservoir, the mounting means forming the back of the reservoir and the metering roll forming the front of the reservoir, (d) liquid inlet means for supplying liquid to the formed reservoir from a source of liquid, and (e) liquid outlet means for returning excess liquid to the source of liquid.

13. The combination of claim 12 wherein the doctor blade mounting means includes inner and outer clamp members and the doctor blade member comprises an elongated flexible blade member secured between the inner and outer clamp members and extending forwardly beyond the latter for engagement of its projecting edge against the surface of the metering roll.

14. The combination of claim 12 wherein the mounting means includes resilient means for urging the doctor blade member resiliently toward the metering roll, and adjustment means associated with the resilient means for varying the degree of resilient force urging the doctor blade member toward the metering roll.

15. The combination of claim 12 wherein the mounting means includes pivot means for moving the doctor blade member arcuately toward and away from the metering roll, resilient means interengaging the doctor blade member and apparatus frame for urging the doctor blade member resiliently toward the metering roll, and adjustment means associated with the resilient means for varying the degree of resilient force urging the doctor blade member toward the metering roll.

16. The combination of claim 12 wherein the liquid metering roll is an ink metering roll and the liquid applying apparatus is a printing press.

* * * * *